US005951383A

United States Patent [19]

Eisenblaetter

[11] Patent Number: 5,951,383

[45] Date of Patent: Sep. 14, 1999

[54] GRINDING AND POLISHING BELT

[75] Inventor: Gerd Eisenblaetter, Koenigsdorf, Germany

[73] Assignee: Gerd Eisenblaetter GmbH, Geretsried, Germany

[21] Appl. No.: 08/875,609

[22] PCT Filed: Dec. 2, 1996

[86] PCT No.: PCT/EP96/05342

§ 371 Date: Aug. 5, 1997

§ 102(e) Date: Aug. 5, 1997

[87] PCT Pub. No.: WO97/20663

PCT Pub. Date: Jun. 12, 1997

[30] Foreign Application Priority Data

Dec. 5, 1995 [DE] Germany ..... 195 45 377

[51] Int. Cl.[6] ..... B24B 21/00

[52] U.S. Cl. ..... 451/296; 451/531; 451/489; 451/399

[58] Field of Search ..... 451/531, 296, 451/489, 399

[56] References Cited

U.S. PATENT DOCUMENTS

| | | | |
|---|---|---|---|
| 3,154,897 | 11/1964 | Howard | 51/399 |
| 3,333,372 | 8/1967 | Gianatasio | 51/399 |
| 3,729,873 | 5/1973 | Sandell | 51/399 |
| 4,788,798 | 12/1988 | DeFranco et al. | 51/406 |
| 5,341,609 | 8/1994 | Gorsuch et al. | 51/399 |

FOREIGN PATENT DOCUMENTS

| | | |
|---|---|---|
| 70 17 102 U | 10/1973 | Germany . |
| 89 04 270 U | 7/1989 | Germany . |
| 94 17 419 U | 4/1995 | Germany . |

*Primary Examiner*—David A. Scherbel
*Assistant Examiner*—Shantese McDonald
*Attorney, Agent, or Firm*—Sixbey, Friedman, Leedom & Ferguson; David S. Safran; Donald R. Studebaker

[57] ABSTRACT

The invention relates to grinding belts and polishing belts, which are particularly suitable for processing enclosed constructions, since they can be re-sealed by simple means and manner after severing to form a ring-shaped endless belt.

24 Claims, 3 Drawing Sheets

GRINDING AND POLISHING BELT

TECHNICAL FIELD OF THE INVENTION

This invention relates to a grinding and polishing belt and particularly to grinding and polishing belts which after separation can be rejoined and a method of rejoining the belts.

BACKGROUND OF THE INVENTION

Grinding and polishing belts in the form of endless belts are used for grinding and polishing of circular pipes, circular wood or similar articles. For this, the grinding belt is, either pushed laterally onto the workpiece to be machined or placed around a grinding belt drive roller of a belt grinding unit. In order to be able to grind or polish enclosed constructions, in which the sliding-on of the grinding belt from the side is not possible, the grinding belt must be cut through to wrap around the item to be machined and then rejoined to form a ring once again. Hitherto the grinding belt was rejoined so that the belt, placed together to form the ring, was bonded over, over its entire length using special tape. This method was indeed very effective and reliable, but on the other hand very time-consuming. In addition, a considerable quantity of woven tape is needed.

SUMMARY OF THE INVENTION

The object of the present invention is, therefore, to make available grinding and polishing belts which can be re-sealed again by a more simple method than hitherto employed. In addition, the length of the endless bands should be made variable by a particular simple method. Furthermore it should enable multi-separation and resealing of the belts to be effected. These tasks are accomplished by the grinding and polishing belts in accordance with the present invention.

In this regard, the invention relates to endless belts, or in other words belts which are closed to form a ring. Such types of belts are basically set forth in the prior art. They comprise a belt-like base, which can be made, for example, from a woven material made of natural or synthetic fibers, for example, cotton or polyester belting could be assigned. One face of the belt is coated with a grinding medium or polishing medium. Examples of such grinding media and polishing media are grinding grit of differing grit size, woven fleece or felt.

This invention is not confined to any particular grinding or polishing belts, but is suitable for all types of such belts. The invention is now described with the aid of grinding belts in the following, without, any restriction being imposed to these alone. Accordingly, the present invention applies to other types of belts as well.

According to a first aspect of the invention, the grinding belt is coated with an adhesive on its rear face not coated with a grinding medium, at least over a part section of its circumference, which if required is covered by a peelable protective film. Advantageously this part section has a length of at least 3 to 4 cm, by way of example a length of 3 to 10 cm and in particular 4 to 6 cm.

Appropriately, the adhesive coating is applied over the entire width of the belt. Advantageously, only a part section is coated with adhesive for each endless belt. However, it is also possible to provide two or more sections having adhesive coatings displaced over the circumference of the grinding belt.

The resealable joint described hereinabove is particularly easy to manufacture and very practicable, wherein the adhesive coating is applied at the joint to the original abutment point of the belt on the rear face of the overlay used originally for initial sealing.

Advantageously, the sections of the grinding belt coated with adhesive may be color marked, for example by dyeing the grinding belt base material. It is particularly desirable to mark additionally the center of each part section by a transverse line or the like.

If, for example, it is intended to grind away a part of the pipe now inaccessible from the sides using the grinding belt according to the invention, the grinding belt is to be severed in the region of the part section provided with adhesive. It is particularly desirable for the separation to be made in the center part of the section, since in this case the best union is attained upon re-bonding. The severed endless belt is now placed around the pipe section, the separated edges placed in abutment with each other again and resealed by pressing on an adhesive overlay, which can also be referred to as an adhesive patch. This adhesive overlay is basically the size of the part section coated with adhesive. Application of the adhesive overlay is thus considerably simpler than making a joint by completely bonding around the endless belt using woven tape as is the case with prior art belts.

The adhesive overlay comprises a carrier material which is coated at least on one face with adhesive. The carrier material can, for example, be a woven layer made of natural or synthetic fibers, i.e. cotton or polyester weave. It is also suitable to use a foil or film made of polymer material.

With respect to the adhesives for the adhesive overlay, only those compatible with the carrier material can be used and provide a secure yet sufficiently flexible joint with the adhesive applied to the grinding belt. The adhesive bond should be secure enough to withstand the loadings generated by the grinding operation, yet at the same time be able to yield to the deformations occurring during grinding.

Such adhesive bonds can, for example, be produced using suitable two or multi-component adhesive bonding systems. In so doing, one component is applied to the part sections of the grinding belt, the other to the adhesive overlay. Where applicable, these components may be activated by applying a solvent on the contact areas, by applying pressure, heat or by other means. Such adhesive procedures are known in the art and are thus not discussed in detail herein.

Examples of such multi-component adhesive bonding systems, are epoxy resin/acid anhydride, epoxy resin/polyamine, polyisocyanate/polyalcohol or butadiene/styrene/polyisocyanate, butadiene/acryionitrile/styrene/polyisocyanate. Also suitable are resin/hardener systems based on epoxides, polyesters, (meth) acrylates and polyurethanes.

The adhesive bond can also bc produced with contact adhesives, with which the adhering faces for creating the bond contact are pressed together under pressure. Such bonding systems include polyurethane or polychloroprene.

Very well suited for use in accordance with the present invention are hot sealing adhesives, which can be activated by heat such as polychlorobutadiene. To produce the adhesive bond the heated adhering faces are pressed together under pressure.

Even so-called bonding agents, with which the adhering faces are joined together under pressure, are suitable for the purpose of this invention. Acrylates and caoutchouc are examples of this type of adhesive.

So long as the adhesive bond between the grinding belt and the adhesive overlay is sufficiently secure to withstand the loadings during the grinding operation and that the adhesive bond is sufficiently flexible to yield to deformations acting upon the grinding belt during operation, any known adhesive may be utilized in accordance with the present invention.

In order to enable multiple opening and sealing of the endless belt, the adhesive overlay can be coated on both faces. The endless belt can be re-severed at the old abutment point and be re-sealed by overlaying another overlay in the same region. If required the faces of the overlay coated with adhesive can be covered using a peelable protective foil or film. To facilitate ease of peeling away the protective foil, the foil can be formed as a sleeve or have crimped over ends.

Alternatively, the endless belt in accordance with the present invention may include a plurality of coated sections, at which the endless belt can be opened successively and can be re-sealed using single-face coated overlays.

BRIEF DESCRIPTION OF THE DRAWINGS

The basic principle of this invention is now described in detail with respect to the drawings, wherein.

DETAILED DESCRIPTION OF THE PRESENT INVENTION

Figure 1:
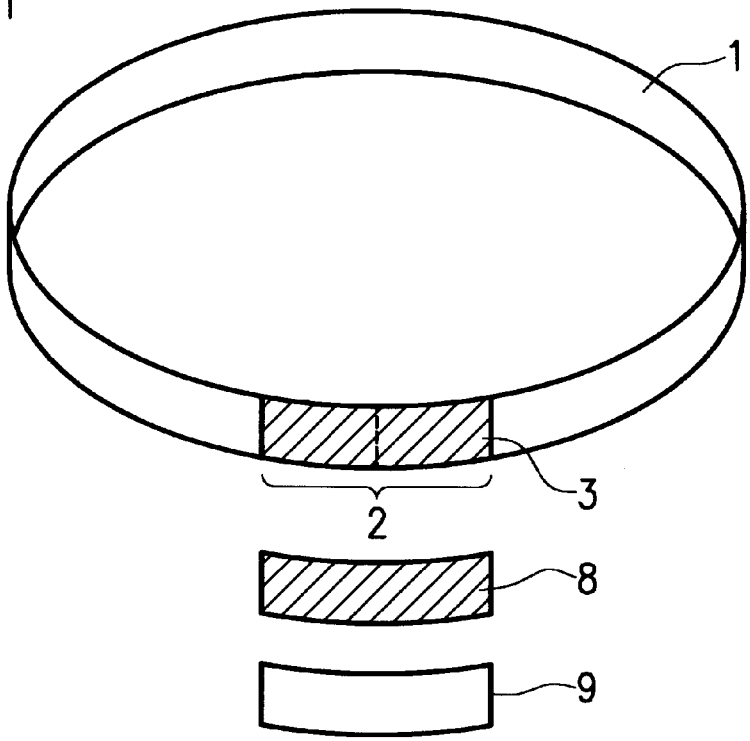
FIG. 1 is a schematic illustration of a grinding belt according to the present invention.
Figure 2:
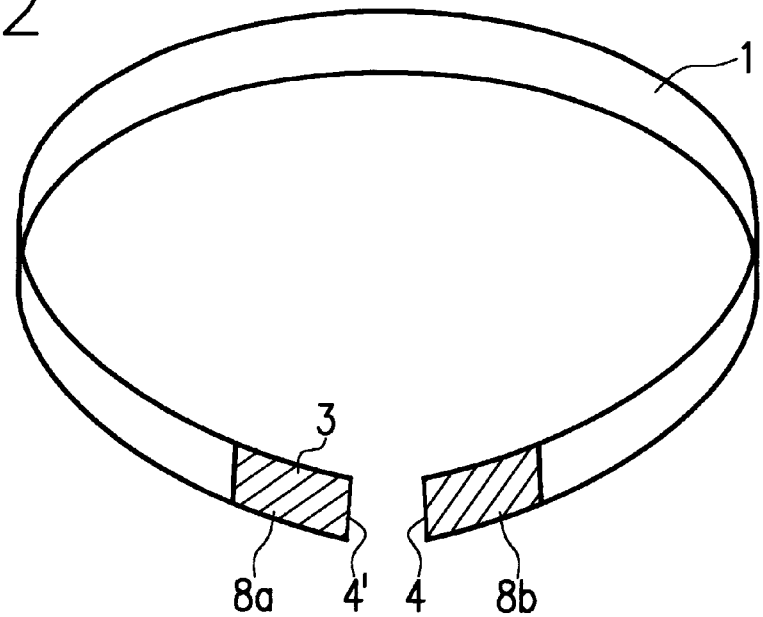
FIG. 2 illustrates the grinding belt of FIG. 1 in a separated state.
Figure 3:
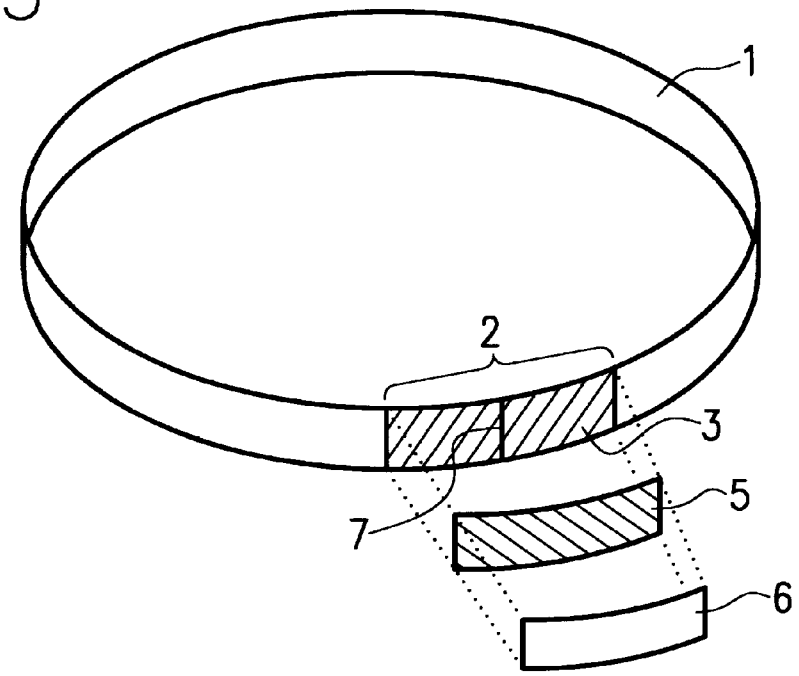
FIG. 3 is an exploded view of a sealed grinding belt having an adhesive overlay coated on both faces.
Figure 5:
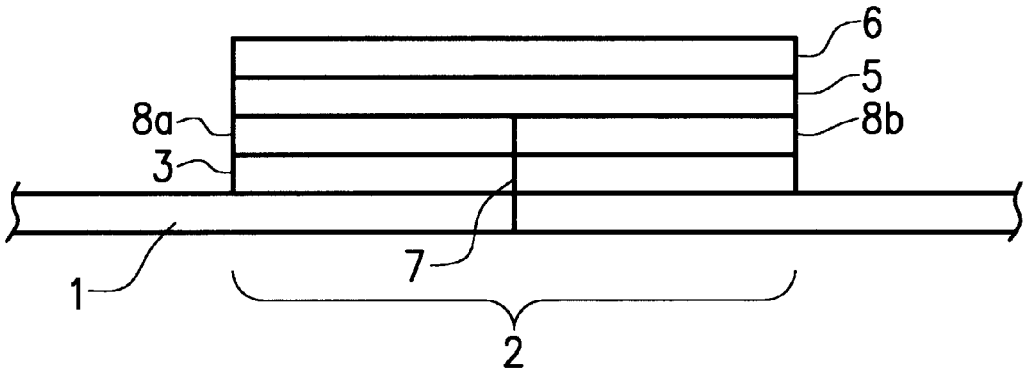
FIG. 5 is a side view of the sealed area of the sealed grinding belt illustrated in FIG. 3.

FIG. 1 shows a grinding belt 1 in accordance with the present invention, for which only one part, section 2, is coated on both faces of the original abutment point 7 using an adhesive 3. On this is bonded an overlay 8 for joining the two ends of the belt, the overlay 8 being also provided with adhesive on its rear face. The rear face adhesive is covered by a peelable protective foil 9. To grind an enclosed construction the grinding belt is separated firstly in the region of the part section 2 coated with adhesive, preferably at its center or at the original abutment point 7 (FIG. 2). The separated grinding belt is then placed around the item to be processed and re-sealed. The two separated ends of the belt at the separation points 4, 4' are placed together, as can be seen in FIG. 3. After peeling off the protective foil on the rear face of the overlay 8*a,* 8*b,* coated with adhesive, an adhesive overlay 5, coated with identical adhesive or other compatible adhesives is placed over the overlay 8*a,* 8*b,* activated if need be by, for example, heat, and firmly pressed upon the grinding belt 1. In the case shown in FIG. 3 the adhesive overlay 5 is coated on both faces with adhesive, and thus covered with protective film or foil 6 on the face not bonded to the grinding belt. The juxtaposed layers being best illustrated in FIG. 5. In this embodiment it is possible to reseparate the grinding belt at the previous separation point and by applying a further overlay over the first overlay already adhered to restore the joint after removing the protective foil or film.

In using multi-component adhesive systems the opposing faces of the overlay are coated with differing adhesive components, wherein the rear face coat of the adhesive overlay has the identical adhesive component, which was coated on the grinding belt. To differentiate between the faces of the overlay, at least one face of the overlay is purposely colored differently from the other face of the overlay.

As already stated, multiple separation can be achieved. In this case, the grinding belt is provided with a plurality of adhesive-coated sections.

For some applications it can be beneficial to be able to vary the length of the grinding belt. Even this is very easily feasible using the grinding belt in accordance with the present invention.

For example, two grinding belts can be separated in the region of their coated part sections. If one now lays the coated end sections of one of the belts with the end sections of the other belt and joins them with an adhesive overlay as described above, an endless belt is produced having a double circumference. It is also possible to cut out part pieces from the endless belts having a plurality of coated part sections and to add these part pieces into another belt. The same applies to part pieces from the following described material which is p referably supplied by the meter.

Accordingly, not only does the present invention make provision for endless belts, the present invention makes provision for an adhesive coated grinding belt material which can be supplied by the meter.

Figure 4:
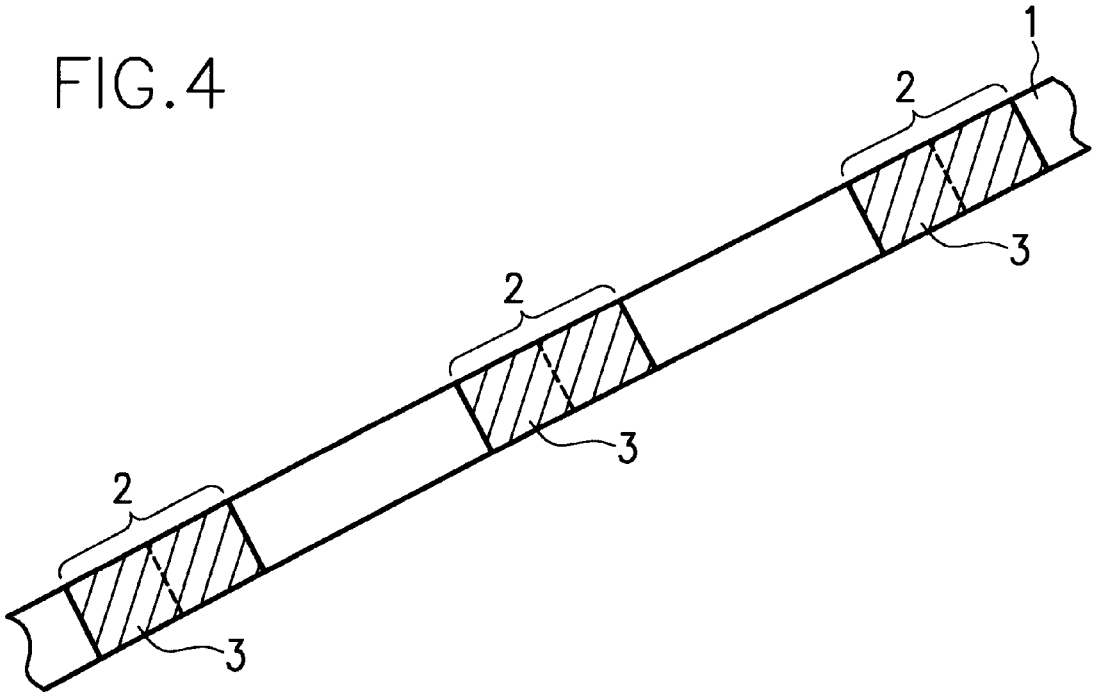
FIG. 4 is a schematic illustration of a continuous grinding belt according to an alternative embodiment of the present invention.

The term "supplied by the meter" is, to be understood as a continuous length of grinding belt not closed to form any ring, featuring, as depicted schematically in FIG. 4, adhesive coated part sections (2) at certain pitches on its rear face, which is void of any grinding medium. A piece of suitable length, as required, is cut off the belt material supplied by the meter, wherein the grinding belt is always severed in the region of the adhesive sections. Preferably, the grinding belt is cut through approximately in the center of the part section 2. The joining together to form an endless belt of suitable length is effected in the manner described above, in which the end pieces of the belt provided with adhesive coating are laid adjacent each other and are united with an adhesive overlay of the correct size.

Furthermore it is possible to coat the entire rear face of the grinding belt material supplied in meters with adhesive. The grinding belt thus attained can be separated at any chosen point and be joined with itself or with other grinding belts in accordance with the invention in the manner described. With the grinding belt coated over the entire length, multiple separation and resealing of the belt are particularly simple, since the belt can be opened at chosen point. Of course, the system of the double-face coated adhesive overlay can be used for the belt material supplied by the meter. However, it is more appropriate to use the adhesive sections of the grinding belt not hitherto used in association with single-face coated adhesive overlays.

Accordingly, while the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

I claim:

1. A method of forming a grinding or polishing belt comprising the steps of;

providing a grinding or polishing belt having a grinding or polishing medium on at least one surface and at least one adhesive coated region;

separating said belt at said adhesive coated region; and reconnecting said belt at said adhesive coated region by applying an adhesive overlay coated on at least one side with an adhesive.

2. The method as defined in claim 1, wherein said adhesive coated region is on said at least one surface of said belt.

3. The method as defined in claim 1, wherein a plurality of adhesive coated regions are provided on said belt.

4. The method as defined in claim 3, wherein said adhesive coated regions of said belt are distinguished from non-adhesive regions and covered with a protective layer.

5. The method as defined in claim 4, wherein said protective layer is a foil layer.

6. The method as defined in claim 1, wherein said adhesive coated regions of said belt are distinguished from non-adhesive regions and covered with a protective layer.

7. The method as defined in claim 6, wherein said protective layer is a foil layer.

8. The method as defined in claim 1, wherein said adhesive coated regions have a length in a range of 3 to 10 cm and a width substantially equal to a width of said belt.

9. The method as defined in claim 8, wherein the length of said adhesive coated regions is in the range of 4 to 6 cm.

10. The method as defined in claim 1, wherein said adhesive overlay is coated on both sides with the adhesive.

11. The method as defined in claim 10, wherein said adhesive overlay is covered with a protective layer.

12. The method as defined in claim 11, wherein said protective layer is a foil layer.

13. A grinding or polishing belt comprising:

a substantially continuous elongated belt having a grinding or polishing medium on at least one surface;

at least one adhesive coated region provided along a length of said belt, said belt being separable at said adhesive coated region; and an adhesive overlay overlying said adhesive coated region, said adhesive overlay having an adhesive on at least one side.

14. The belt as defined in claim 13, wherein said adhesive coated region is on said at least one surface of said belt.

15. The belt as defined in claim 13, wherein a plurality of adhesive coated regions are provided on said belt.

16. The belt as defined in claim 15, wherein said adhesive coated regions of said belt are distinguished from non-adhesive regions and covered with a protective layer.

17. The belt as defined in claim 16, wherein said protective layer is a foil layer.

18. The belt as defined in claim 13, wherein said adhesive coated regions of said belt are distinguished from non-adhesive regions and covered with a protective layer.

19. The belt as defined in claim 18, wherein said protective layer is a foil layer.

20. The belt as defined in claim 13, wherein said adhesive coated regions have a length in a range of 3 to 10 cm and a width substantially equal to a width of said belt.

21. The belt as defined in claim 20, wherein the length of said adhesive coated regions is in the range of 4 to 6 cm.

22. The belt as defined in claim 13, wherein said adhesive overlay is coated on both sides with the adhesive.

23. The belt as defined in claim 22, wherein said adhesive overlay is covered with a protective layer.

24. The belt as defined in claim 23, wherein said protective layer is a foil layer.

* * * * *